US010603915B2

(12) United States Patent
Miyajima et al.

(10) Patent No.: US 10,603,915 B2
(45) Date of Patent: Mar. 31, 2020

(54) LIQUID EJECTING HEAD AND FLOW PASSAGE STRUCTURE

(71) Applicant: SEIKO EPSON CORPORATION, Tokyo (JP)

(72) Inventors: Hiroki Miyajima, Matsumoto (JP); Kenichiro Matsuo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/232,729

(22) Filed: Dec. 26, 2018

(65) Prior Publication Data

US 2019/0193400 A1 Jun. 27, 2019

(30) Foreign Application Priority Data

Dec. 27, 2017 (JP) ..... 2017-250347
Aug. 22, 2018 (JP) ..... 2018-155602

(51) Int. Cl.
*B41J 2/14* (2006.01)

(52) U.S. Cl.
CPC ..... *B41J 2/1433* (2013.01); *B41J 2/14201* (2013.01); *B41J 2/14233* (2013.01); *B41J 2002/14403* (2013.01); *B41J 2002/14419* (2013.01)

(58) Field of Classification Search
CPC .... B41J 2/1618; B41J 2/1623; B41J 2/04581; B41J 2/04588; B41J 2/04593; B41J 2/14201; B41J 2/1433; B41J 2002/14233; B41J 2002/14403; B41J 2002/14419; B41J 2002/14491
See application file for complete search history.

(56) References Cited

U.S. PATENT DOCUMENTS 5,963,234 A 10/1999 Miyazawa et al.
2006/0256159 A1* 11/2006 Owaki ..... B41J 2/14233 347/54
2015/0042719 A1 2/2015 Fukuzawa et al.

FOREIGN PATENT DOCUMENTS

JP H09-314836 A 12/1997
JP 2015-036245 A 2/2015
JP 2015-057315 A 3/2015

* cited by examiner

*Primary Examiner* — Thinh H Nguyen
(74) *Attorney, Agent, or Firm* — Workman Nydegger

(57) ABSTRACT

A flow passage structure includes a flow passage member that constitutes a portion of a wall surface of a liquid storage chamber; a flexible film that is laminated on the flow passage member and constitutes a portion of the wall surface of the liquid storage chamber; a sealing body that is laminated on a side opposite to the flow passage member with the flexible film interposed therebetween and forms a space in which the flexible film is exposed; communication passages that are formed in a region around the liquid storage chamber in the sealing body and causes the space to communicate with an atmosphere in a case where the sealing body is seen in a plan view from a direction in which the flow passage member and the flexible film are laminated; and a support portion that supports the flexible film in the communication passage.

20 Claims, 11 Drawing Sheets

LIQUID EJECTING HEAD AND FLOW PASSAGE STRUCTURE

BACKGROUND

1. Technical Field

The present invention relates to a technique of ejecting liquid such as ink.

2. Related Art

In the related art, a liquid ejecting head that ejects liquid such as ink supplied from a liquid storage chamber to a pressure chamber from a nozzle by generating pressure change in the pressure chamber has been proposed. In this type of liquid ejecting head, when pressure fluctuation occurs in the liquid storage chamber by liquid introduction into the liquid storage chamber and pressure change in the pressure chamber, the pressure may be transferred to the pressure chamber, which may cause an ejection failure of the liquid. For this reason, for example, in the liquid ejecting head disclosed in JP-A-2015-057315, a recessed portion constituting a liquid storage chamber (manifold) is closed and sealed with a flexible film (film) so that a portion of a wall surface is constituted of the flexible film. According to this configuration, the ejection failure is suppressed by absorbing the pressure fluctuation of the liquid storage chamber by bending the flexible film. Furthermore, in JP-A-2015-057315, a space is formed in which the flexible film bends on a side opposite to the liquid storage chamber with the flexible film interposed therebetween, and the space is communicated with an atmospheric vent (through-hole) via a communication passage extending around the liquid storage chamber. With this configuration, the air in the space in which the flexible film bends can enter and exit from the atmospheric vent according to the movement of the flexible film, so that the movement of the flexible film is facilitated.

However, in the configuration in which a communication passage that communicates a space in which a flexible film bends to the atmosphere is provided as in JP-A-2015-057315, since the cross-sectional area of the communication passage becomes smaller as the width of the communication passage becomes narrower, the air resistance increases, and thereby, it becomes difficult for the air in the space in which the flexible film bends to enter and exit from the atmosphere via the communication passage. Therefore, the flexible film becomes difficult to move and the effect of absorbing the pressure fluctuation of the liquid storage chamber is deteriorated. On the contrary, as the width of the communication passage becomes wider, since the flexible film exposed into the communication passage easily bends in the communication passage, the sealing property between the flow passage member and the flexible film is deteriorated in the region around the liquid storage chamber, and leak of liquid may occur.

SUMMARY

An advantage of some aspects of the invention is to suppress deterioration of sealing property between a flow passage member and a flexible film around a liquid storage chamber while increasing an effect of absorbing pressure fluctuation of the liquid storage chamber.

According to an aspect of the invention, there is provided a flow passage structure including: a flow passage member that constitutes a portion of a wall surface of a liquid storage chamber; a flexible film that is laminated on the flow passage member and constitutes a portion of the wall surface of the liquid storage chamber; a sealing body that is laminated on a side opposite to the flow passage member with the flexible film interposed therebetween and forms a space in which the flexible film is exposed; communication passages that are formed in a region around the liquid storage chamber in the sealing body and causes the space to communicate with an atmosphere in a case where the sealing body is seen in a plan view from a direction in which the flow passage member and the flexible film are laminated; and a support portion that supports the flexible film in the communication passage. In this case, since the flexible film is supported by the support portion in the communication passage formed in the region around the liquid storage chamber that seals the flow passage member and the flexible film in the sealing body, even if the width of the communication passage is increased, it is difficult to bond the flow passage member with the flexible film exposed into the communication passage bends so that the deterioration of the sealing property can be suppressed.

"A region around the liquid storage chamber" is a region outside the liquid storage chamber in a plan view of the sealing body. For example, in a case where an opening penetrating the flow passage member constitutes a portion of the liquid storage chamber, a region overlapping the flow passage member constituting the opening corresponds to "a region around the liquid storage chamber". The flexible film may not adhere to the flow passage member immediately above the support portion.

In the flow passage structure, it is preferable that in a cross section including the support portion among cross sections of the communication passages that intersect with a direction in which the communication passage extends, an area of a portion occupied by the support portion be smaller than an area of the other portions. In this case, since the area of the portion occupied by the support portion is smaller than the area of the other portions, the air resistance by the support portion can be reduced in the cross section including the support portion among the cross sections of the communication passage interesting with the direction in which the communication passage extends. For this reason, the air in the space in which the flexible film bends easily enters and exits from the atmosphere via the communication passage, and the movement of the flexible film exposed in the space of the sealing body is facilitated, so that the effect of absorbing the pressure fluctuation of the liquid storage chamber can be increased. In this case, it is possible to suppress deterioration of the sealing property between the flow passage member and the flexible film around the liquid storage chamber while increasing the effect of absorbing the pressure fluctuation of the liquid storage chamber.

In the flow passage structure, it is preferable that the communication passage communicate with the atmosphere via an atmospheric vent distanced from the liquid storage chamber, and a width of the communication passage in the cross section of the communication passage that intersects with the direction in which the communication passage extends be larger than a diameter of the atmospheric vent. In this case, since the width of the communication passage in the cross section of the communication passage which intersects the direction in which the communication passage extends is larger than the diameter of the atmospheric vent, the air resistance in the communication passage in the direction in which the communication passage extends can be reduced as compared with the case where the width of the communication passage is smaller than the diameter of the atmospheric vent.

In the flow passage structure, it is preferable that the atmospheric vent be a through-hole formed in the flexible film. In this case, since the width of the communication passage is larger than the diameter of the atmospheric vent formed in the flexible film, the air resistance in the communication passage in the direction in which the communication passage extends can be reduced as compared with the configuration in which the width of the communication passage is smaller than the diameter of the atmospheric vent.

In the flow passage structure, it is preferable that the atmospheric vent be formed in the flow passage member. In this case, since the atmospheric vent is formed in a flow passage member having a liquid storage chamber, it is easy to form the atmospheric vent away from the liquid storage chamber, so that it is possible to facilitate the routing of the communication passage. Moreover, since the width of the communication passage is larger than the diameter of the atmospheric vent formed in the flow passage member, the air resistance in the communication passage in the direction in which the communication passage extends can be reduced as compared with the configuration in which the width of the communication passage is smaller than the diameter of the atmospheric vent.

In the flow passage structure, it is preferable that the support portion be an island portion that is disposed in the communication passage. In this case, since the support portion is the island portion disposed in the communication passage, depending on the number, arrangement and shape of the island portions, the area of the portion occupied by the support portion can be made smaller than the area of the other portions, so that it is easy to reduce the air resistance in the communication passage.

In the flow passage structure, it is preferable that a plurality of the island portions be arranged side by side in a direction in which the communication passage extends. In this case, since a plurality of island portions are arranged side by side in the direction in which the communication passage extends, and the plurality of island portions overlap when viewed from that direction, the resistance in the direction in which the communication passage extends, that is, the direction through which air passes can be reduced.

In the flow passage structure, it is preferable that the support portion be a rail portion that projects into the communication passage from one or both sides of side surfaces of the communication passage facing each other. In this case, since the support portion is a rail portion projecting from one or both sides of side surfaces facing each other of the communication passage into the communication passage, depending on the number, arrangement, and shape of the rail portion, the area of the portion occupied by the support portion can be made smaller than the area of other portions, so that it is easy to reduce the air resistance in the communication passage.

In the flow passage structure, it is preferable that the width of the communication passage be ½ or more of a maximum width of a cross section of the space among cross sections of the communication passages that intersect with a direction in which the communication passage extends. In this case, by setting the width of the communication passage to be ½ or more of the maximum width of the space in the cross section of the communication passage which intersects the direction in which the communication passage extends, the air resistance in the communication passage in the direction in which the communication passage extends can be greatly reduced.

In the flow passage structure, it is preferable that the sealing body be constituted of a support plate that is laminated on the flexible film and a fixation plate that is laminated on the support plate on a side opposite to the flexible film, and the support portion support the flexible film that protrudes from the fixation plate toward the flexible film. In this case, since the support portion protrudes from the fixation plate toward the flexible film to support the flexible film, it is possible to suppress bending of the flexible film from the flow passage member into the communication passage.

In the flow passage structure, it is preferable that in a plan view of the sealing body, the communication passage be formed in a region corresponding to one end of the liquid storage chamber in the sealing body.

In the flow passage structure, it is preferable that a plurality of the liquid storage chambers be formed in the flow passage member, a plurality of the spaces each corresponding to the plurality of liquid storage chambers be formed in the sealing body, and the communication passage communicate with each of the spaces.

According to another aspect of the invention, there is provided a liquid ejecting head including: the flow passage structure according to an aspect; and a nozzle that ejects liquid supplied from the liquid storage chamber. In this case, it is possible to provide a liquid ejecting head provided with a flow passage structure capable of suppressing deterioration of the sealing property between the flow passage member and the flexible film around the liquid storage chamber while increasing the effect of absorbing the pressure fluctuation of the liquid storage chamber.

According to still another aspect of the invention, there is provided a liquid ejecting apparatus including: the liquid ejecting head according to another aspect; and a control device that causes the liquid ejecting head to eject liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
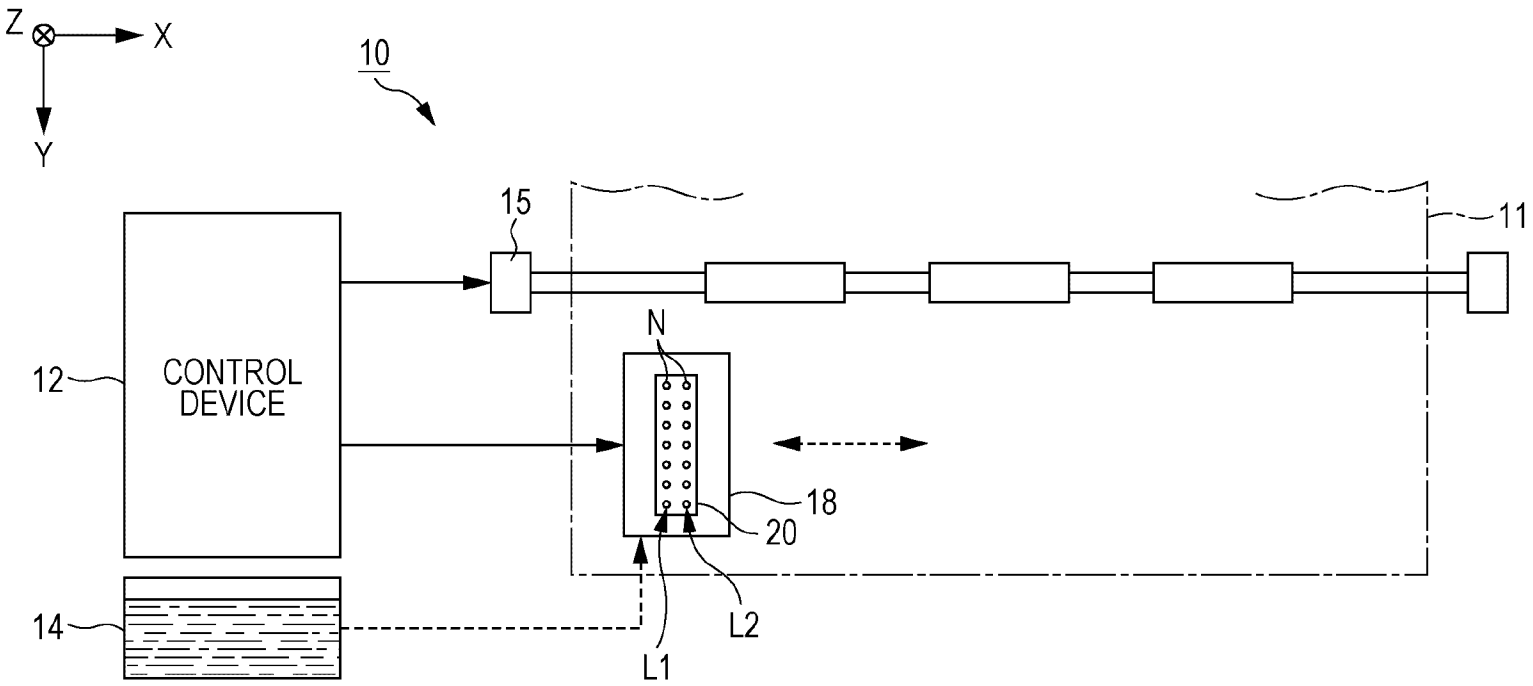
FIG. 1 is a structural view of a liquid ejecting apparatus according to a first embodiment.

FIG. 1 is a partial structural view of a liquid ejecting apparatus 10 according to a first embodiment of the invention. The liquid ejecting apparatus 10 of the first embodiment is an ink jet type printing apparatus that ejects ink as an example of liquid onto a medium 11 such as printing paper. The liquid ejecting apparatus 10 shown in FIG. 1 includes a control device 12, a transport mechanism 15, a carriage 18, and a liquid ejecting head 20. The liquid ejecting apparatus 10 is mounted with a liquid container 14 for storing ink.

The liquid container 14 is an ink tank type cartridge made of a box-shaped container attachable and detachable to and from the main body of the liquid ejecting apparatus 10. The liquid container 14 is not limited to a box-shaped container, and may be an ink pack type cartridge made of a bag-shaped container. Ink is stored in the liquid container 14. The ink may be black ink, or color ink. The ink stored in the liquid container 14 is pressurized and fed to the liquid ejecting head 20 by a pump (not shown).

The control device 12 integrally controls each element of the liquid ejecting apparatus 10. The transport mechanism 15 transports the medium 11 in a Y direction under the control of the control device 12. The liquid ejecting head 20 ejects ink supplied from the liquid container 14 from each of a plurality of nozzles N onto the medium 11 under the control of the control device 12.

The liquid ejecting head 20 is installed in the carriage 18. In FIG. 1, a case where a single liquid ejecting head 20 is installed in the carriage 18 is exemplified. However, the invention is not limited thereto, and a plurality of liquid ejecting heads 20 may be installed in the carriage 18. The control device 12 reciprocates the carriage 18 in an X direction intersecting (orthogonal in FIG. 1) in the Y direction. A desired image is formed on a surface of the medium 11 by the liquid ejecting head 20 ejecting ink onto the medium 11 in parallel with the repetition of the transport of the medium 11 and the reciprocation of the carriage 18. A plurality of liquid ejecting heads 20 may be installed in the carriage 18. A direction perpendicular to an X-Y plane (plane parallel to the surface of the medium 11) is defined as a Z direction.

Liquid Ejecting Head

Figure 2:
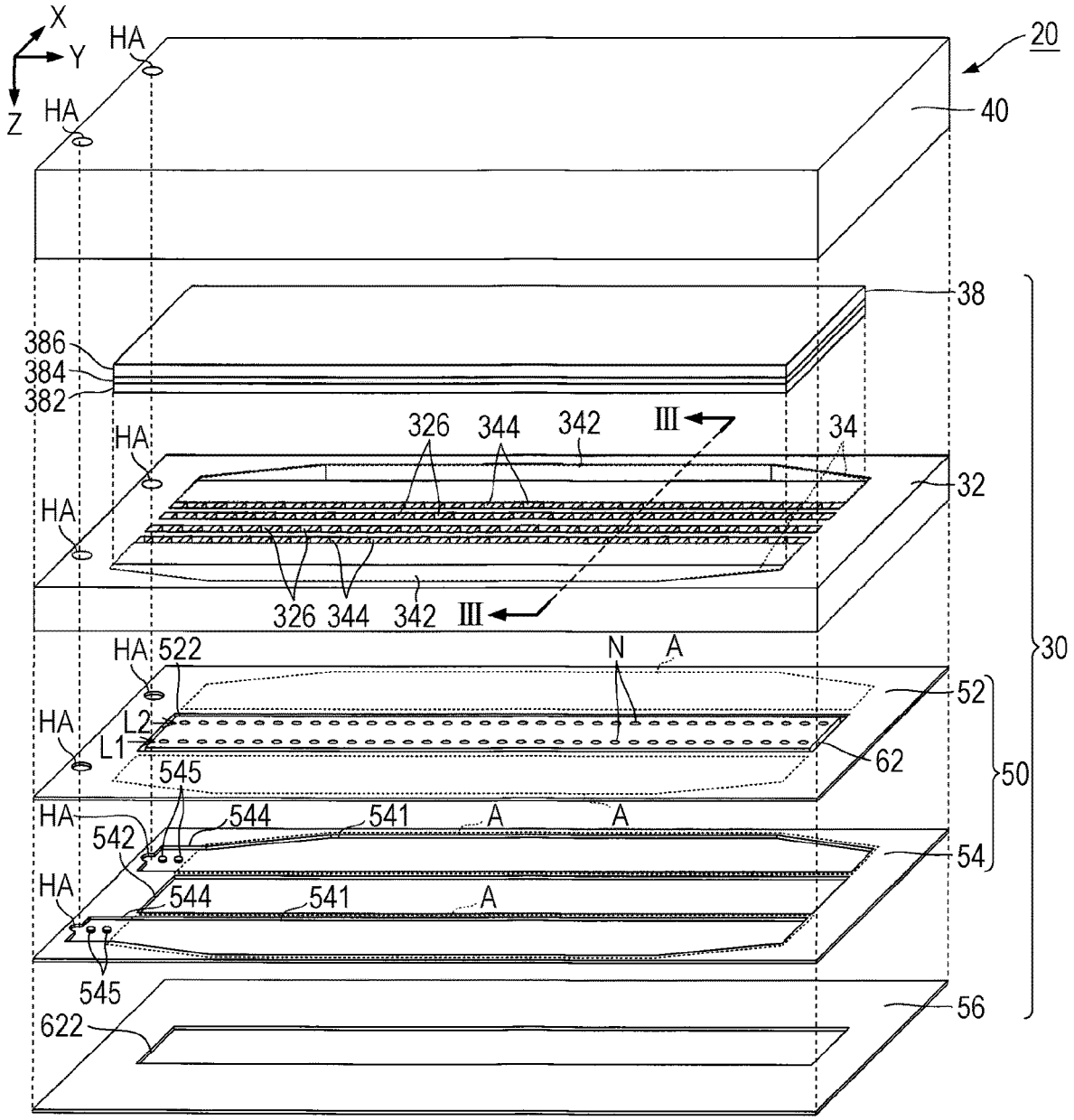
FIG. 2 is an exploded perspective view of a liquid ejecting head.
Figure 3:
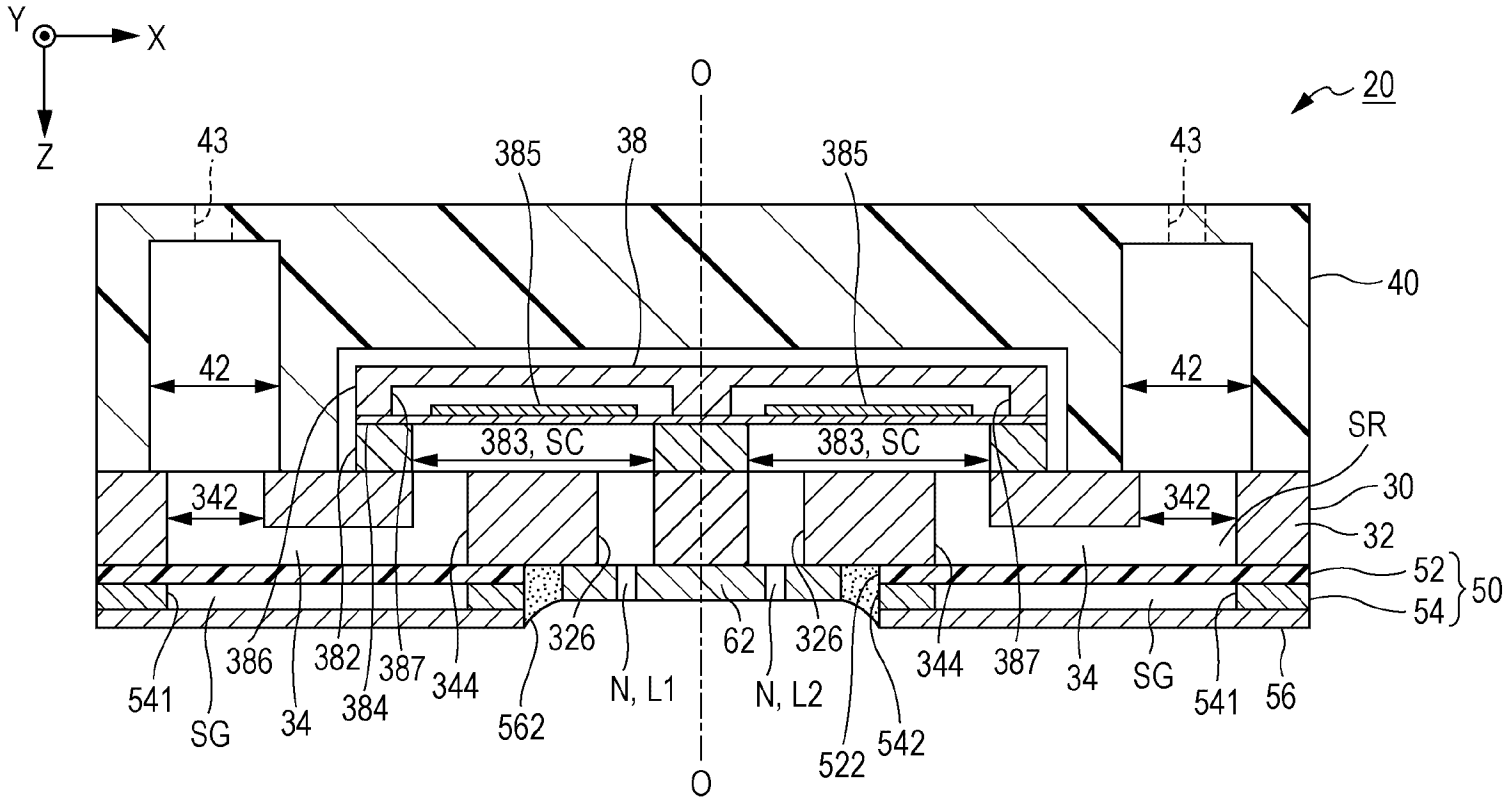
FIG. 3 is a sectional view taken along line III-III of the liquid ejecting head shown in FIG. 2.

FIG. 2 is an exploded perspective view of the liquid ejecting head 20. FIG. 3 is a sectional view taken along line III-III of the liquid ejecting head 20 shown in FIG. 2. As shown in FIGS. 2 and 3, the liquid ejecting head 20 is configured by fixing (bonding) a case member 40 to a head body 30 having an ejection surface on which nozzles N for ejecting ink are formed. The head body 30 has a structure in which a flow passage member 32 is provided, a nozzle plate 62 on which the plurality of nozzles N are formed, a compliance plate 50, and a fixation plate 56 are laminated on one side (surface on the positive side in the Z direction) thereof and a laminated portion 38 including a pressure chamber substrate 382 is laminated on the other side (surface on the negative side in the Z direction) thereof. Each element of the head body 30 is mutually fixed by, for example, an adhesive. The flow passage member 32, the compliance plate 50, and the fixation plate 56 of the present embodiment constitute a flow passage structure.

The nozzle plate 62 is a flat plate material constituting the ejection surface on which the plurality of nozzles N are arranged in the Y direction. The nozzle plate 62 is made of, for example, a silicon material. The plurality of nozzles N are formed of two rows of nozzle rows L1 and L2. Each of the nozzle rows L1 and L2 is an aggregation of the plurality of nozzles N arranged along the Y direction. The arrangement of the nozzle rows L1 and L2 is not limited to the one shown in the present embodiment. For example, each of the nozzle rows L1 and L2 may be arranged by being shifted in the Y direction. Moreover, the number of nozzle rows formed on the nozzle plate 62 is not limited to two, and may be one.

Figure 4:
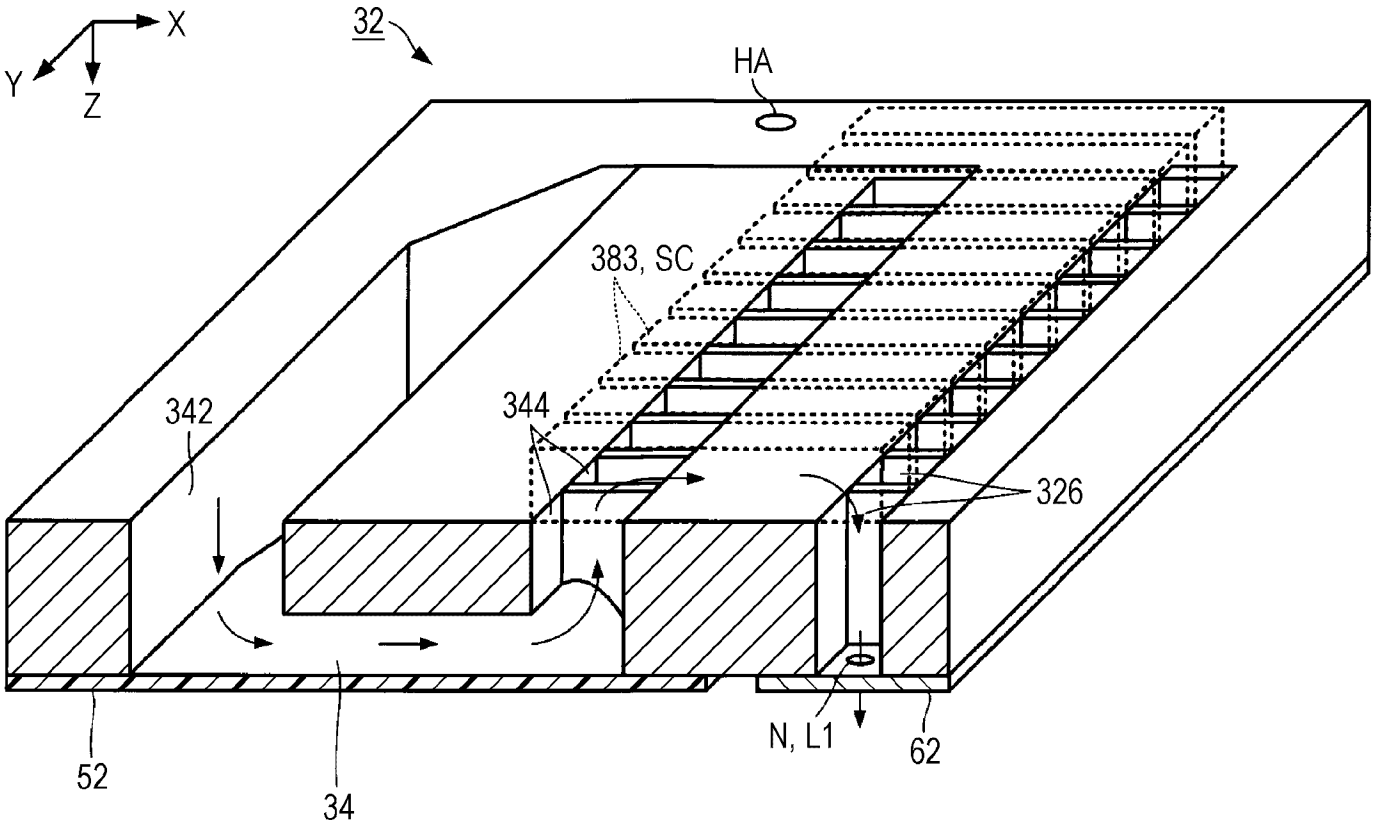
FIG. 4 is a partial cross-sectional perspective view of the liquid ejecting head.

In the liquid ejecting head 20 according to the present embodiment, a structure corresponding to the nozzle row L1 (left portion of FIG. 3) and a structure corresponding to the nozzle row L2 (right portion of FIG. 3) are formed substantially in line symmetrically with respect to a virtual line O-O in the X direction, and both structures are substantially common. Therefore, in the following description, the attention is focused on the structure corresponding to the nozzle row L1 (left portion from virtual line O-O of FIG. 3), and the description of the elements corresponding to the nozzle row L2 will be omitted for the sake of convenience. FIG. 4 is a partial cross-sectional perspective view of the structure corresponding to the nozzle row L1. In FIG. 4, a plurality of pressure chambers SC are indicated by broken line.

The flow passage member 32 shown in FIGS. 2 to 4 is a flat flow passage substrate constituting a flow passage of ink. The flow passage member 32 is made of, for example, a silicon material. A second liquid storage chamber 34 and a plurality of nozzle side communication flow passages 326 are formed in the flow passage member 32. The second liquid storage chamber 34 includes an inflow port 342 through which ink flows and a plurality of supply side communication flow passages 344. The plurality of supply side communication flow passages 344 and the plurality of nozzle side communication flow passages 326 are through-holes formed for each of the nozzles N, and the second liquid storage chamber 34 is an opening common to the plurality of nozzles N.

The laminated portion 38 is constituted by laminating the pressure chamber substrate 382 forming the pressure chambers SC communicating with the nozzles N, a vibration plate 384, and a protective plate 386 in this order. However, the invention is not limited to such a configuration, and the laminated portion 38 may be constituted without the protective plate 386. Moreover, the vibration plate 384 and the pressure chamber substrate 382 may be formed integrally. A plurality of opening portions 383 constituting the pressure chambers SC (cavities) communicating with each of the nozzles N are formed in the pressure chamber substrate 382. The pressure chamber substrate 382 is made of, for example, a silicon material similar to the flow passage member 32.

The vibration plate 384 is installed on a surface of the pressure chamber substrate 382 opposite to the flow passage member 32. The vibration plate 384 is an elastically vibratable flat plate material. The vibration plate 384 and the flow passage member 32 are opposed to each other with a gap therebetween inside each of the opening portions 383 formed on the pressure chamber substrate 382. The pressure chambers SC that generate pressure for ejecting ink from each of the nozzles N is constituted by a space interposed between the flow passage member 32 and the vibration plate 384 inside the opening portions 383 of the pressure chamber substrate 382. Each of the supply side communication flow passages 344 of the flow passage member 32 communicates the second liquid storage chamber 34 described later with the pressure chambers SC, and each of the nozzle side communication flow passages 326 of the flow passage member 32 communicates the pressure chambers SC with the nozzles N.

A plurality of piezoelectric elements 385 corresponding to different nozzles N (pressure chambers SC) are formed on the surface of the vibration plate 384 opposite to the pressure chamber substrate 382. Each of the piezoelectric elements 385 is a driving element in which a piezoelectric substance is interposed between electrodes facing each other. Each of the piezoelectric elements 385 individually vibrates by a drive signal supplied from the control device 12. The protective plate 386 is an element for protecting each of the piezoelectric elements 385, and is fixed on a surface of the pressure chamber substrate 382 (vibration plate 384) by, for example, an adhesive. Each of the piezoelectric elements 385 is stored in a recessed portion 387 formed on a surface of the protective plate 386 on the vibration plate 384 side. When each of the piezoelectric elements 385 vibrates according to the drive signal supplied from the control device 12, the vibration plate 384 vibrates in interlocking with the piezoelectric elements 385. As a result, the pressure of ink inside the pressure chambers SC fluctuates and the ink is ejected from the nozzles N. In this manner, the piezoelectric elements 385 function as pressure generating elements that fluctuate the pressure inside the pressure chambers SC to eject the ink inside the pressure chambers SC from the nozzles N. The piezoelectric elements 385 are connected with the control device 12 via a flexible printed cable (FPC: flexible printed circuit), a chip on film (COF) (not shown), or the like.

A surface of the case member 40 on a positive side in the Z direction (hereinafter, referred to as "bonding surface") is fixed on a surface of the flow passage member 32 on a negative side of the Z direction by an adhesive, for example. The case member 40 is made of a molding resin material such as a plastic material. In a case where the case member 40 is made of a molding resin material, it can be molded integrally by an injection molding of the molding resin material. The case member 40 is a case for storing the ink supplied from the plurality of pressure chambers SC, and has a structure in which a first liquid storage chamber 42 that is communicated with the second liquid storage chamber 34 by the inflow port 342 as an opening portion. The first liquid storage chamber 42 communicates with an inlet 43 for introducing the ink.

Such a second liquid storage chamber 34 and first liquid storage chamber 42 are common spaces over the plurality of nozzles N, and store the ink supplied from the liquid container 14 in the inlet 43. The second liquid storage chamber 34 is formed of a space elongated in the Y direction. The second liquid storage chamber 34 of the present embodiment has a shape in which the flow passage is expanded from the inflow port 342 side toward the supply side communication flow passages 344 (outflow port) side. The plurality of pressure chambers SC are arranged in one direction (Y direction), and the plurality of supply side communication flow passages 344 are arranged along the arrangement of the plurality of pressure chambers SC in the Y direction.

As shown in FIG. 4, the ink flowing into the second liquid storage chamber 34 from the first liquid storage chamber 42 is branched by the plurality of supply side communication flow passages 344, is supplied to each of the pressure chambers SC in parallel, and is charged. Then, the ink passes through the nozzle side communication flow passages 326 and the nozzles N from the pressure chambers SC due to the pressure fluctuation in accordance with the vibration of the vibration plate 384 and is ejected to the outside. That is, the pressure chambers SC function as spaces that generate pressure for ejecting ink from the nozzles N, and the second liquid storage chamber 34 and the first liquid storage chamber 42 function as a liquid storage chamber SR (reservoir or manifold) for storing the ink supplied to the plurality of pressure chambers SC.

Flow Passage Structure

Figure 5:
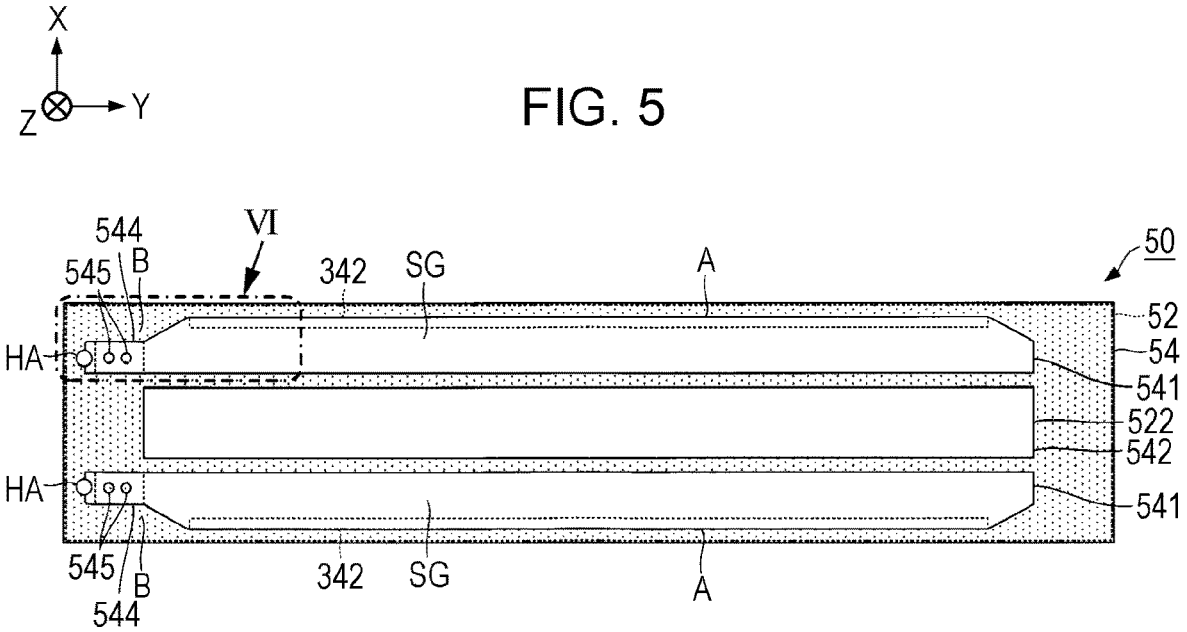
FIG. 5 is a plan view of a compliance plate constituting a portion of a flow passage structure.
Figure 6:
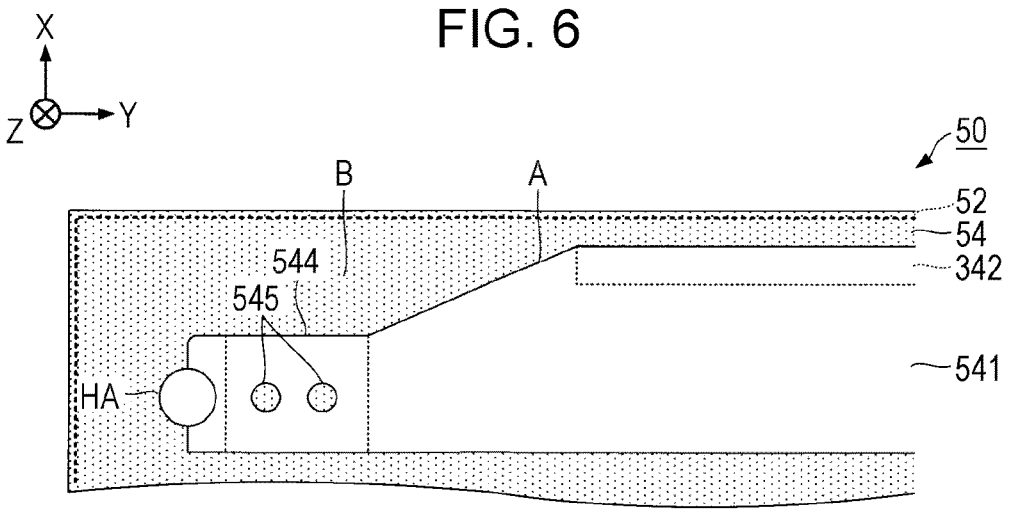
FIG. 6 is an enlarged view of VI portion shown in FIG. 5.

FIG. 5 is a plan view of the compliance plate 50 constituting a portion of the flow passage structure of the first embodiment as seen from the Z direction. FIG. 6 is an enlarged view of VI portion shown in FIG. 5. As shown in FIGS. 3 and 5, the compliance plate 50 of the present embodiment is an element for suppressing the pressure fluctuation of ink inside the liquid storage chamber SR, and includes a flexible film 52 (compliance substrate) and a support plate 54. The flexible film 52 is a flexible member formed in a film shape, and constitutes a portion of a wall surface (specifically, bottom surface) of the liquid storage chamber SR. For example, polyphenylene sulfide (PPS), aromatic polyamide (aramid), stainless steel (SUS), and the like can be used as a material of the flexible film 52 as long as the flexible film 52 can bend. The case where the second liquid storage chamber 34 corresponding to the nozzle row L1 and the second liquid storage chamber 34 corresponding to the nozzle row L2 are sealed with a single flexible film 52 has been described in FIG. 3. However, the invention is not limited thereto, and both second liquid storage chambers 34 may be sealed with separate flexible films 52. The flexible film 52 is laminated in the Z direction of the flow passage member 32 and the support plate 54 is laminated on a side opposite to the flow passage member 32 interposing the flexible film 52 therebetween. The Z direction of the present embodiment corresponds to a lamination direction of the flow passage member 32, the flexible film 52, and the support plate 54.

As shown in FIG. 5, the support plate 54 is a flat plate formed of a highly rigid material such as stainless steel (SUS), and supports the flexible film 52 so that the liquid storage chamber SR is sealed with the flexible film 52. In the support plate 54, an opening portion 541 constituting a space where the flexible film 52 is exposed is formed in a compliance region A overlapping the liquid storage chamber SR in a plan view (plan view from Z direction). The compliance region A (region of the flexible film 52 to which the opening portion 541 is exposed) is a region that has a compliance function capable of absorbing the pressure fluctuation inside the liquid storage chamber SR by deformation (bending vibration) of the flexible film 52. In a region B around the liquid storage chamber SR not overlapping the liquid storage chamber SR in a plan view, the flow passage member 32 and the flexible film 52 adhere to each other. Accordingly, the flow passage member 32 and the flexible film 52 are sealed so that the ink does not leak from the liquid storage chamber SR. A space (inner space of the opening portion 541) constituted by the opening portion 541 of the support plate 54 communicates with the atmosphere via a communication passage 544, and functions as a compliance space SG for deforming the flexible film 52 so as to absorb the pressure fluctuation inside the liquid storage chamber SR.

The compliance plate 50 is fixed on the fixation plate 56. The fixation plate 56 is formed into a predetermined shape with a highly rigid material such as stainless steel. A plurality of opening portions 622 corresponding to each nozzle plate 62 are formed in the fixation plate 56, respectively. An opening portion 522 corresponding to the plurality of opening portions 622 is formed in the flexible film 52, and an opening portion 542 corresponding to the plurality of opening portions 622 is formed in the support plate 54. The support plate 54 of the compliance plate 50 is fixed on the fixation plate 56 so that the nozzle plate 62 is exposed from the opening portions 522, 542, and 562. A space inside the opening portions 522, 542, and 562 (specifically, a gap between the inner peripheral surfaces of the opening portions 522, 542, and 562 and an outer peripheral surface of the nozzle plate 62) is filled with a filler formed of, for example a resin material.

The positive side of the opening portion 541 of the support plate 54 in the Z direction is sealed with the fixation plate 56 by fixing the support plate 54 on the fixation plate 56, and the space interposed between the flexible film 52 and the fixation plate 56 inside the opening portion 541 becomes the above-described compliance space SG. The support plate 54 and the fixation plate 56 of the present embodiment function as a sealing body in which a space (compliance space SG) where the flexible film 52 is exposed is formed. In the present embodiment, the case where the sealing body is formed with the support plate 54 and the fixation plate 56 as separate bodies is exemplified. However, the invention is not limited thereto, and a sealing body may be formed by integrating the support plate 54 and the fixation plate 56 together. According to the compliance plate 50 constituted as described above, even if pressure fluctuation occurs in the liquid storage chamber SR, the pressure fluctuation can be absorbed by deformation of the flexible film 52. Since the opening portion 541 of the support plate 54 communicates with the atmosphere via the communication passage 544, the air inside the opening portion 541 can enter and exit from the atmosphere via the communication passage 544 according to the movement of the flexible film 52, so that the movement of the flexible film 52 is facilitated. The fixation plate 56 and the nozzle plate 62 may be formed integrally. In this case, the nozzles N may be formed on the fixation plate 56, and the opening portion 541 may be sealed with the nozzle plate 62.

Communication Passage

Here, a specific configuration example of the communication passage 544 that communicates the above-described opening portion 541 of the support plate 54 with the atmosphere will be described with reference to the drawings. As shown in FIGS. 5 and 6, the communication passage 544 is formed in the region B around the liquid storage chamber SR that seals the flow passage member 32 and the flexible film 52 of the support plate 54. The region B is a non-compliance region in which the opening portion 541 is not overlapping the liquid storage chamber SR. In the flexible film 52, the flow passage member 32 and the flexible film 52 are sealed around the liquid storage chamber SR by adhering to the flow passage member 32 at the region B. An atmospheric vent HA is formed at a position away from the liquid storage chamber SR in the region B in a direction of a nozzle row (negative side of Y direction in FIG. 5) in the flow passage member 32 and the flexible film 52. As shown in FIG. 2, the atmospheric vent HA is a through-hole that penetrates the flow passage member 32, the flexible film 52, and the case member 40 and communicates the communication passage 544 of the support plate 54 with the atmosphere. The atmospheric vent HA is disposed away from the liquid storage chamber SR in the negative side of the Y direction, and the communication passage 544 extends from the opening portion 541 in the negative side of the Y direction and communicates with the atmospheric vent HA. As described above, the communication passage 544 of the present embodiment is an air passage that continues to the opening portion 541 of the support plate 54, and communicates the opening portion 541 with the atmospheric vent HA. Since the atmospheric vent HA is formed in the flow passage member 32 in which the liquid storage chamber SR exists, the atmospheric vent HA can be easily formed away from the liquid storage chamber SR, and it is possible to facilitate the routing of the communication passage 544.

Since the cross-sectional area of the communication passage 544 that intersects with the direction (Y direction) in which the communication passage 544 extends becomes smaller as the width of the cross section is narrower, the air resistance increases, so that the air in the opening portion 541 hardly enters and exits from the atmospheric vent HA via the communication passage 544 when the flexible film 52 bends. Therefore, the flexible film 52 becomes difficult to move and the effect of absorbing the pressure fluctuation of the liquid storage chamber SR is deteriorated.

As a configuration of suppressing the air resistance of the communication passage 544, it is also conceivable to increase the thickness of the support plate 54 to secure the height of the cross section of the communication passage 544 sufficiently. However, in the configuration that the thickness of the support plate 54 is increased, since a surface of the fixation plate 56 approaches the medium 11, a possibility of the medium 11 coming into contact with the surface of the fixation plate 56 increases. On the other hand, it is possible to set the position of the liquid ejecting head 20 in the Z direction to secure a predetermined gap between the surface of the fixation plate 56 and the medium 11 in order to suppress the contact of the medium 11 with respect to the fixation plate 56. However, with the above-described configuration, the distance between the medium 11 and the nozzle plate 62 increases. Therefore, an error tends to occur at the position where the liquid ejected from the nozzles N land on the surface of the medium 11, and as a result, there is a possibility that the print quality may be deteriorated. Considering above circumstances, the configuration of reducing the air resistance by sufficiently securing the width of the communication passage 544 is more preferable than the configuration of securing the height of the communication passage 544.

Figure 7:
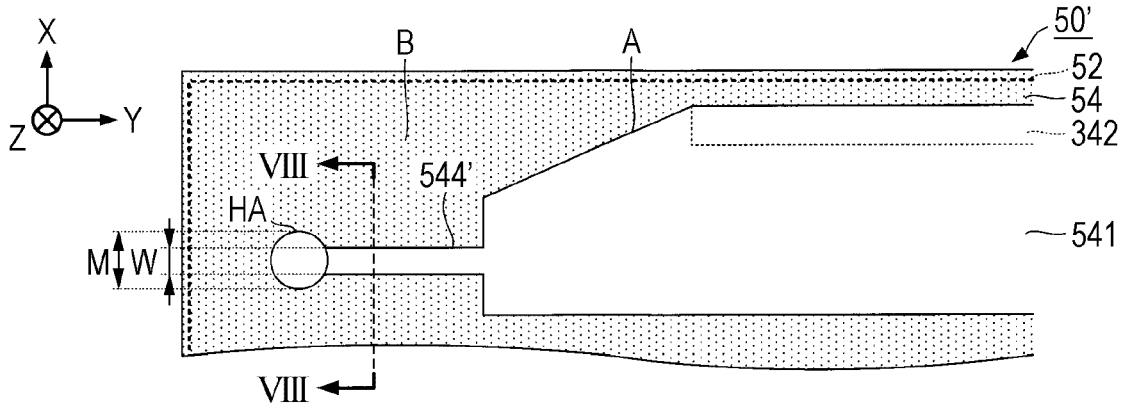
FIG. 7 is a plan view of a compliance plate according to a first comparative example.
Figure 8:
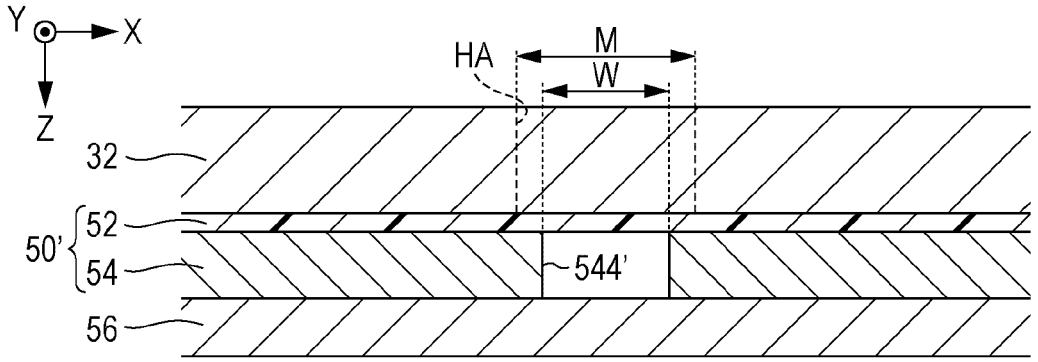
FIG. 8 is a sectional view taken along line VIII-VIII shown in FIG. 7.

FIGS. 7 and 8 are views showing a configuration of a compliance plate 50' according to a first comparative example of the first embodiment. FIG. 7 is a plan view showing a communication passage 544' of the compliance plate 50' according to the first comparative example, and corresponds to FIG. 6. FIG. 8 is a sectional view taken along line VIII-VIII shown in FIG. 7. The communication passage 544' of FIGS. 7 and 8 has a width narrower than that of the communication passage 544 of FIG. 6. Specifically, a width W' of the communication passage 544' is smaller than a diameter M of the atmospheric vent HA, and the width W of the communication passage 544 is larger than the diameter M of the atmospheric vent HA.

As shown in FIGS. 7 and 8, as the width W' of the communication passage 544' becomes smaller, the air in the opening portion 541 hardly enters and exits from the atmospheric vent HA via the communication passage 544 when the flexible film 52 bends. Then, it becomes difficult to move the flexible film 52 and the effect of absorbing the pressure fluctuation of the liquid storage chamber SR is deteriorated. Depending on the print pattern, the amplitude of the pressure vibration of the liquid storage chamber SR increases to exceed the meniscus pressure resistance in the nozzles N, and the meniscus may be destroyed, so that ejection failure such as dot omission occurs.

For example, it is found that dot omission occurs due to insufficient absorption of the pressure fluctuation of the liquid storage chamber SR in a print pattern in which solid ejection (when ejection duty is 100%), excitation (for example, case of repeating ejection (print) and non-ejection (blank) alternately), and solid ejection are continuous. Here, the ejection duty means the ratio of the ejected ink amount with respect to the maximum possible ink ejection amount per unit time.

Figure 9:
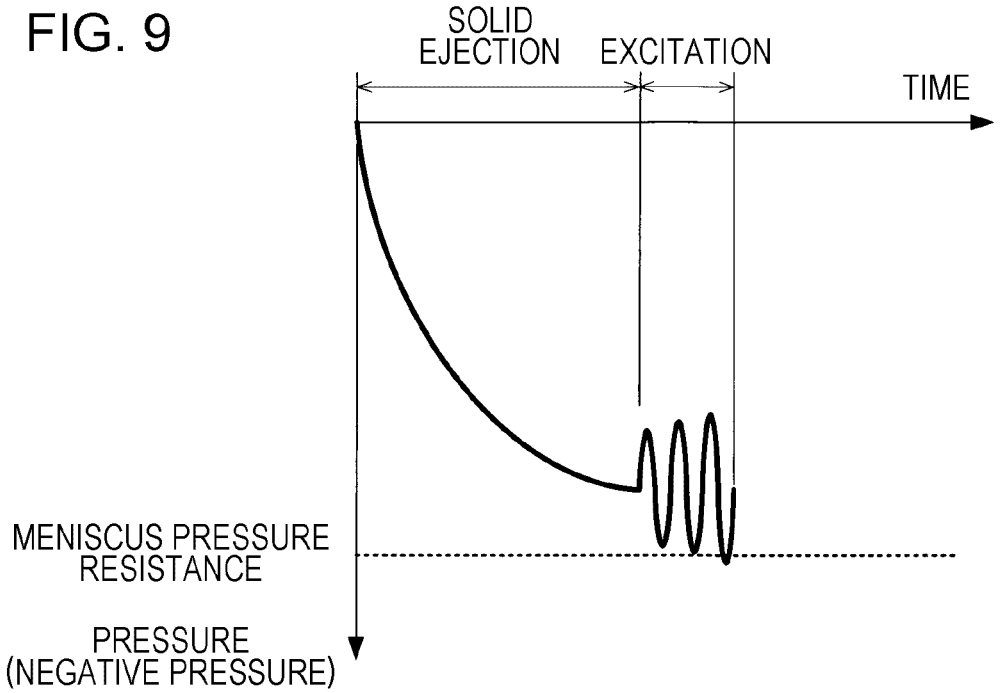
FIG. 9 is a graph showing pressure transition of a liquid storage chamber in a specific print pattern.

FIG. 9 is a graph showing pressure transition of the liquid storage chamber SR in a specific print pattern such as the occurrence of dot omission due to insufficient absorption of the pressure fluctuation of the liquid storage chamber SR. The vertical axis of FIG. 9 is pressure (negative pressure) and the horizontal axis is time. As shown in FIG. 9, since the ejection amount of ink is large in the solid ejection, the pressure inside the nozzles N reduces abruptly due to the solid ejection, the meniscus in the nozzles N is greatly pulled toward the pressure chambers SC side. Therefore, the pressure vibration caused by the subsequent excitation cannot be absorbed, and the amplitude becomes large and exceeds the meniscus pressure resistance to cause the dot omission in the subsequent continuous solid ejection.

Therefore, in the present embodiment, it is easy for the air in the opening portion 541 to enter and exit from the atmospheric vent HA via the communication passage 544 when the flexible film 52 bends by widening the width W of the communication passage 544. Accordingly, the movement of the flexible film 52 is facilitated, and it is possible to increase the effect of absorbing the pressure fluctuation of the liquid storage chamber SR. When the movement of the flexible film 52 is facilitated, the pressure fluctuation is absorbed by the movement of the flexible film 52 and the amplitude becomes smaller even if it is excited as shown in FIG. 9, so that it does not exceed the meniscus pressure resistance. Accordingly, it is possible to suppress the occurrence of the dot omission in the subsequent continuous solid ejection.

However, as the width W of the communication passage 544 becomes wider, the flexible film 52 easily bends inside the communication passage 544 unless the flexible film 52 exposed into the communication passage 544 is not supported, so that the sealing property between the flow passage member 32 and the flexible film 52 around the liquid storage chamber SR is deteriorated.

Figure 10:
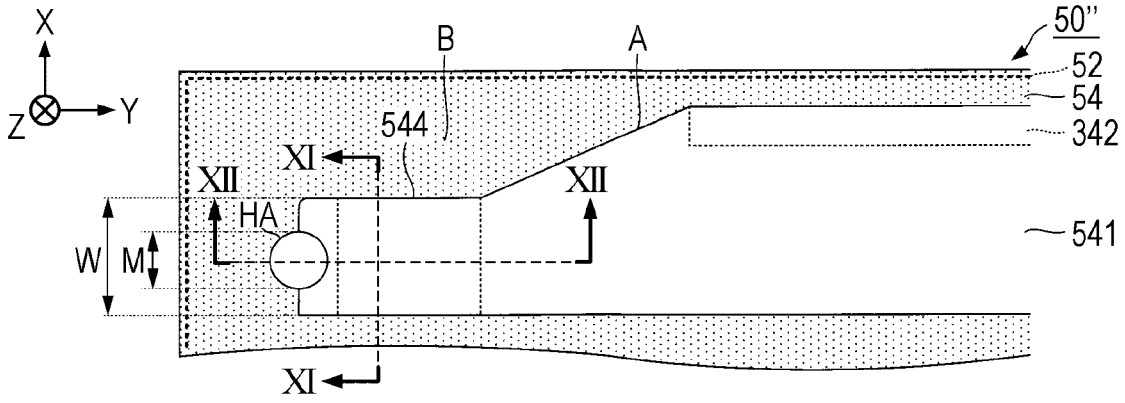
FIG. 10 is a plan view showing a configuration of a compliance plate according to a second comparative example.
Figure 11:
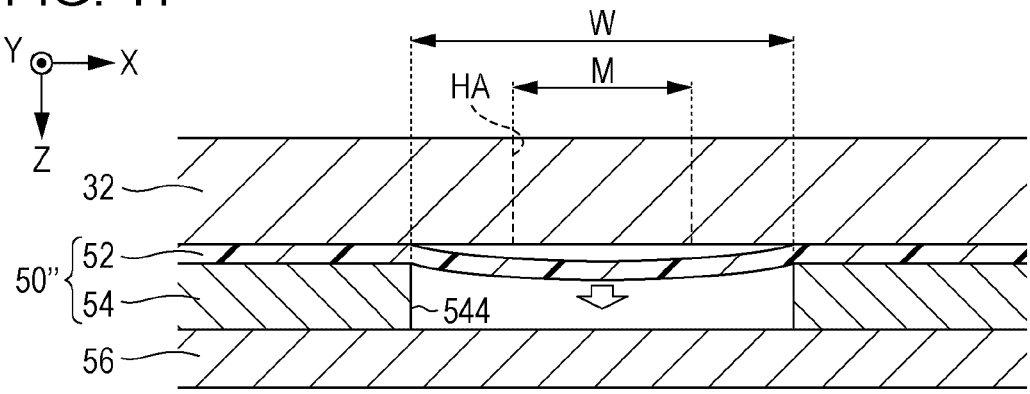
FIG. 11 is a sectional view taken along line XI-XI in FIG. 10.
Figure 12:
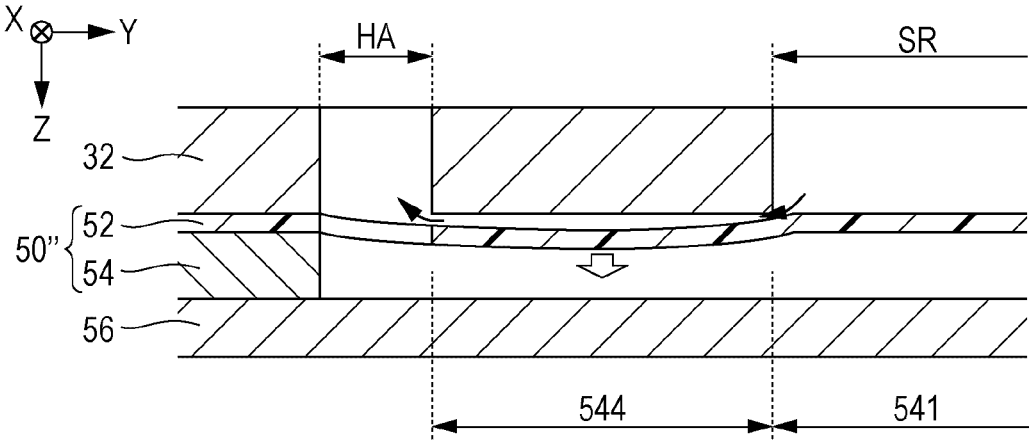
FIG. 12 is a sectional view taken along line XII-XII shown in FIG. 10.

FIGS. 10 to 12 are views showing a configuration of a compliance plate 50" according to a second comparative example of the first embodiment. FIG. 10 is a plan view showing a configuration of a communication passage 544" of the compliance plate 50" according to the second comparative example, and corresponds to FIG. 7. FIG. 11 is a sectional view taken along line XI-XI in FIG. 10, and FIG. 12 is a sectional view taken along line XII-XII shown in FIG. 10. The width W of the communication passage 544" of the second comparative example shown in FIGS. 11 and 12 is wider than the width W' of the communication passage 544' of the first comparative example shown in FIG. 7, and the same as the width W of the communication passage 544 of the first embodiment shown in FIG. 6.

As the width W becomes wider as the communication passage 544" of FIGS. 10 to 12, the flexible film 52 is easily bent into the communication passage 544 when the flow passage member 32, the flexible film 52, and the support plate 54 are laminated at the time of manufacturing the liquid ejecting head 20 unless the flexible film 52 exposed into the communication passage 544 is not supported. Therefore, as white arrows shown in FIGS. 11 and 12, since the portion of the flexible film 52 exposed to the communication passage 544 is away from the flow passage member 32 and becomes hard to adhere, the sealing property between the flow passage member 32 and the flexible film 52 around the liquid storage chamber SR is deteriorated. When the sealing property is deteriorated, leak of ink occurs as shown in black arrows of FIG. 12, which may cause problems such as leak of the ink of the liquid storage chamber SR to the atmospheric vent HA. In the present embodiment, by supporting the flexible film 52 exposed to the communication passage 544 with a support portion 545 as shown in FIG. 6, it is possible to suppress the deterioration of the sealing property between the flow passage member 32 and the flexible film 52 around the liquid storage chamber SR.

Figure 13:
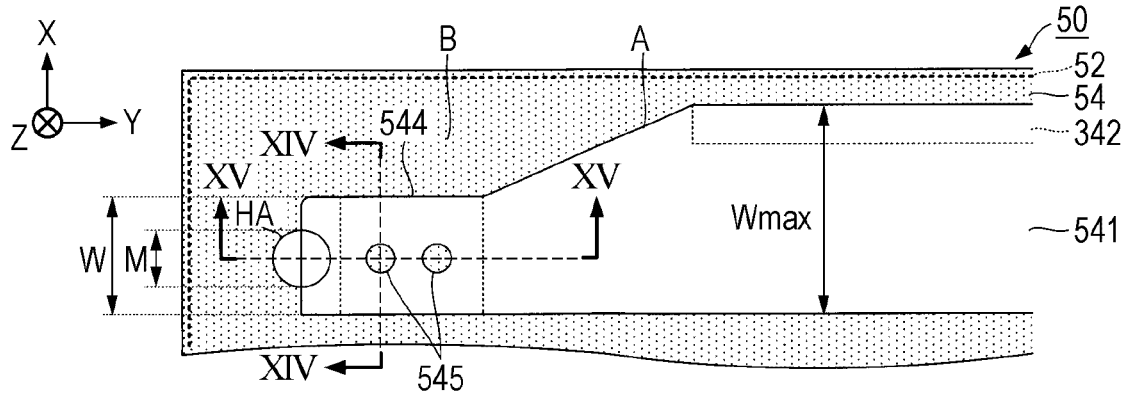
FIG. 13 is an operation explanatory view of the compliance plate of the first embodiment.
Figure 14:
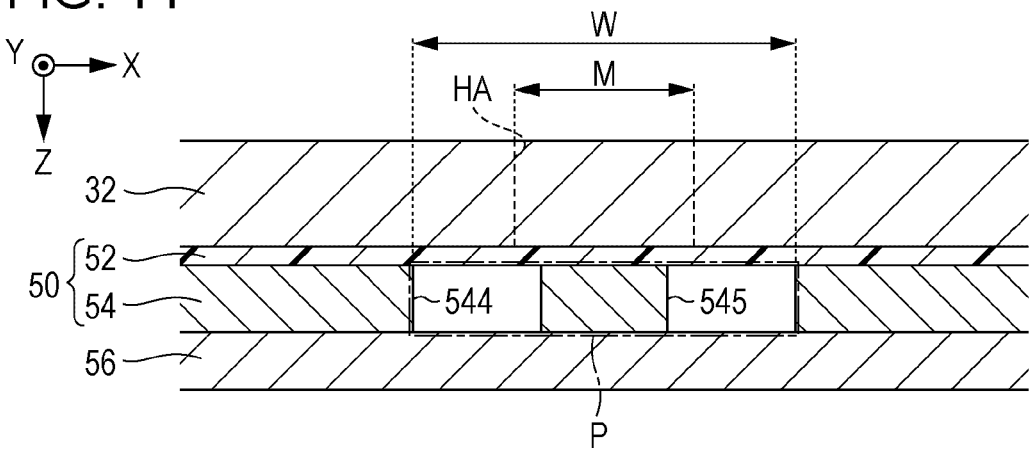
FIG. 14 is a sectional view taken along line XIV-XIV shown in FIG. 13.
Figure 15:
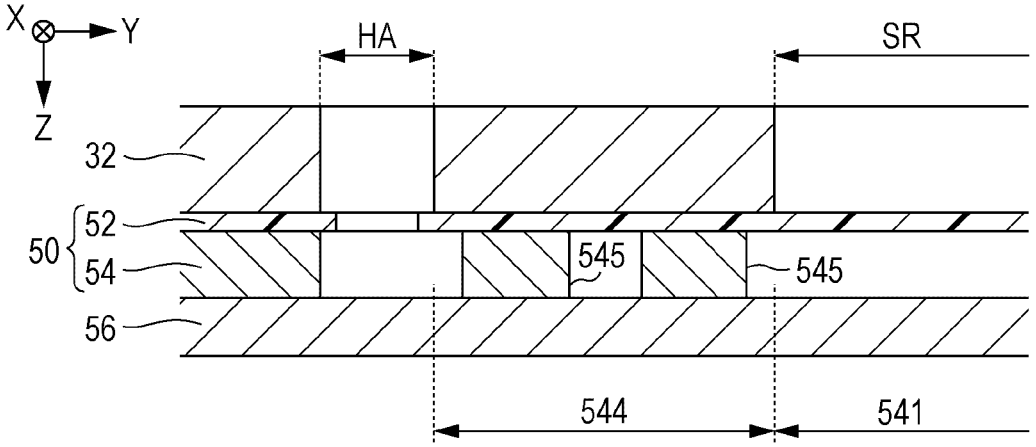
FIG. 15 is a sectional view taken along line XV-XV shown in FIG. 13.

Operations and effects of the compliance plate 50 of the present embodiment will be described in detail with reference to the drawings. FIGS. 13 to 15 are explanatory views of operations of the compliance plate 50 of the present embodiment. FIG. 13 is a plan view of the communication passage 544, and corresponds to FIG. 6. FIG. 14 is a sectional view taken along line XIV-XIV shown in FIG. 13, and FIG. 15 is a sectional view taken along line XV-XV shown in FIG. 13. The flow passage member 32 and the fixation plate 56 are omitted in FIG. 13. As shown in FIG. 13 to FIG. 15, the support portion 545 that supports the flexible film 52 exposed to the communication passage 544 is provided in the first embodiment. The support portion 545 of FIG. 13 is formed of a plurality of island portions provided in the communication passage 544. A case of constituting the support portion 545 with two island portions is exemplified in FIG. 13. Each of the island portions is provided discontinuously from the support plate 54, and protrudes toward the flow passage member 32 from the fixation plate 56 to support the flexible film 52. Each of the island portions of the present embodiment is a cylindrical member having a thickness from the fixation plate 56 to the flexible film 52, and is fixed to both the flexible film 52 and the fixation plate 56 by an adhesive and the like. As shown in FIG. 14, each of the island portions of the present embodiment is aligned in a straight line passing through the center of the communication passage 544 and extending along the Y direction.

As shown in FIGS. 14 and 15, according to the configuration of the present embodiment, even if the width W of the communication passage 544 is widened, it is possible to support the portion of the flexible film 52 exposed to the communication passage 544 with the support portion 545 in an attachment direction (negative side of the Z direction) to the flow passage member 32. Therefore, since bending of the flexible film 52 into the communication passage 544 can be suppressed when laminating the flow passage member 32, the flexible film 52, and the support plate 54 at the time of manufacturing the liquid ejecting head 20, it is possible to suppress the deterioration of the sealing property between the flow passage member 32 and the flexible film 52 around the liquid storage chamber SR.

As shown in FIG. 13, in the present embodiment, the width W (width in the X direction in a plan view from the Z direction) of the cross section of the communication passage 544 that intersects with the direction (Y direction) in which the communication passage 544 extends is larger than the diameter M of the atmospheric vent HA. Accordingly, compared with the case of FIG. 7 where the width W of the communication passage 544 is smaller than the diameter M of the atmospheric vent HA, the air resistance in the extending direction of the communication passage 544, that is, a direction (Y direction) through which the air passes can be reduced. Therefore, the movement of the flexible film 52 is facilitated, and it is possible to increase the effect of absorbing the pressure fluctuation of the liquid storage chamber SR. Furthermore, in a plan view from the Z direction, by setting the width W of the communication passage 544 to be ½ or more of the maximum width Wmax (maximum width in a plan view from the Z direction in the X direction) of the opening portion 541 in a cross section of the communication passage 544 that intersects with the direction (Y direction) in which the communication passage 544 extends, it is possible to reduce the air resistance inside the communication passage 544 in the direction in which the communication passage 544 extends.

As shown in FIG. 14, in a cross section P of the communication passage 544 that intersects with the direction (Y direction) in which the communication passage 544 extends, the area of the portion occupied by the support portion 545 is smaller than the area of the other portions (area of a portion through which the air passes). With this configuration, the air resistance caused by the support portion 545 can be reduced. Therefore, since the air in the opening portion 541 where the flexible film 52 bends becomes easy to enter and exit from the atmospheric vent HA via the communication passage 544, the movement of the flexible film 52 of the compliance region A exposed to the opening portion 541 is facilitated, so that it is possible to increase the effect of absorbing the pressure fluctuation of the liquid storage chamber SR. According to the present embodiment, it is possible to increase the sealing property between the flow passage member 32 and the flexible film 52 around the liquid storage chamber SR while increasing the effect of absorbing the pressure fluctuation of the liquid storage chamber SR.

The two island portions constituting the support portion 545 of the present embodiment are disposed side-by-side in the direction (Y direction) in which the communication passage 544 extends toward the atmospheric vent HA. With this configuration, since the plurality of island portions overlap seen from the Y direction, the resistance in the direction in which the communication passage 544 extends, that is, the direction through which the air passes the communication passage 544 toward atmospheric vent HA can be reduced.

Figure 16:
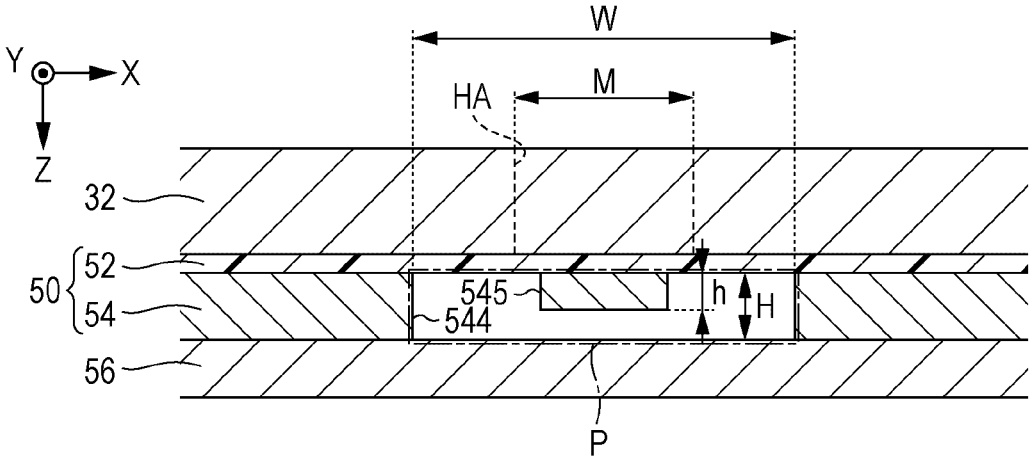
FIG. 16 is a sectional view of the compliance plate according to a first modification example.

A case where each of the island portions constituting the support portion 545 of FIG. 13 is fixed to both the flexible film 52 and the fixation plate 56 by an adhesive is exemplified. However, the invention is not limited thereto, and each of the island portions may be fixed to either one of the flexible film 52 and the fixation plate 56 by an adhesive and the like, and may not be fixed to the other one. For example, in a first modification example shown in FIG. 16, a case where each of the island portions constituting the support portion 545 adheres and is fixed to the flexible film 52 is exemplified. FIG. 16 is a sectional view of the compliance plate 50 of the first modification example, and corresponds to FIG. 14. Even with configuration of FIG. 16, since it is possible to suppress the flexible film 52 bending into the communication passage 544, the deterioration of the sealing property between the flow passage member 32 and the flexible film 52 around the liquid storage chamber SR can be suppressed. In the configuration of FIG. 16, the thickness h of each of the island portions is thinner than the thickness H of the support plate 54, and a gap is formed between the fixation plate 56 and the island portion. In the configuration of FIG. 16, since it is possible to reduce the thickness h of each of the island portions, it is possible to reduce the area of a portion occupied by the support portion 545 in the cross section P of the communication passage 544 than the case of fixing each of the island portions to both the flexible film 52 and the fixation plate 56. Therefore, the air resistance by the support portion 545 can be reduced.

Figure 17:
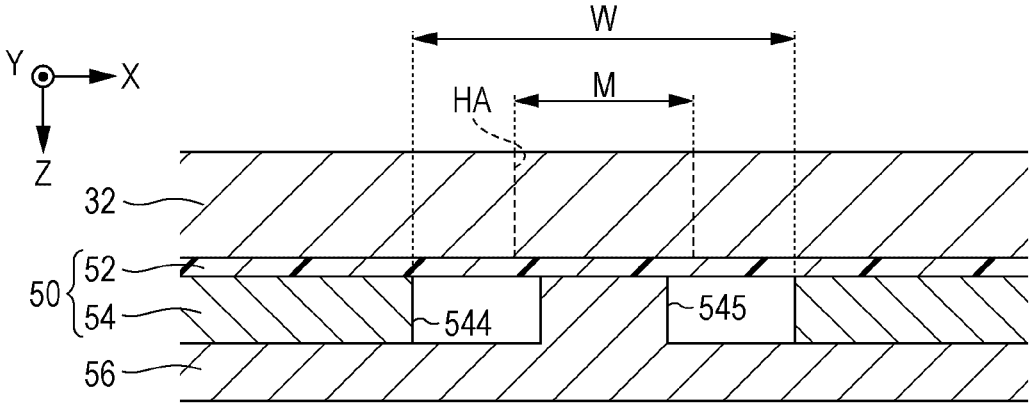
FIG. 17 is a sectional view of the compliance plate according to a second modification example.

A case where each of the island portions constituting the support portion 545 of FIG. 13 is separate from the fixation plate 56 is exemplified. However, the invention is not limited thereto, and for example, each of the island portions may be formed integrally with the fixation plate 56 as a second modification example shown in FIG. 17. FIG. 17 is a sectional view of the compliance plate 50 according to the second modification example, and corresponds to FIG. 14. Each of the island portions of FIG. 17 protrudes toward the flow passage member 32 from the fixation plate 56 and supports the flexible film 52. As described above, the case where each of the island portions is formed integrally with the fixation plate 56, each of the island portions may or may not adhere to the flexible film 52. In such a configuration, since the bending of the flexible film 52 into the communication passage 544 can be suppressed, the deterioration of the sealing property between the flow passage member 32 and the flexible film 52 around the liquid storage chamber SR can be suppressed. Furthermore, not only the island portions, but also the support plate 54 may be formed integrally with the fixation plate 56. Even with such a configuration, it is possible to suppress the flexible film 52 from bending into the communication passage 544.

Figure 18:
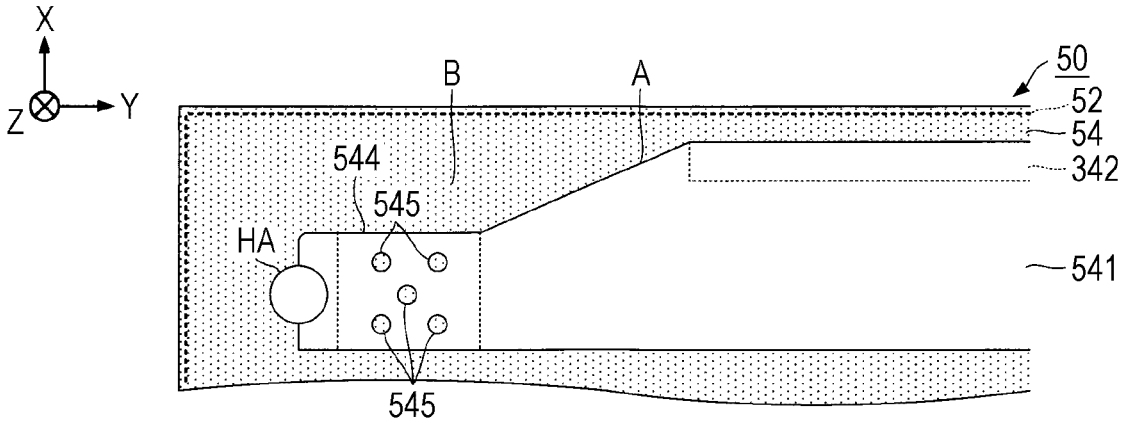
FIG. 18 is a plan view of the compliance plate according to a third modification example.

The number, arrangement, and shape (such as length, width, outer shape, thickness, size) of the island portions constituting the support portion 545 are not limited to the examples of the present embodiment. For example, the number of the each of the island portions may be increased to reduce the diameter as in a third modification example shown in FIG. 18. FIG. 18 is a plan view of the compliance plate 50 according to the third modification example, and corresponds to FIG. 13. In FIG. 18, a case where five island portions are disposed inside the communication passage 544, and the diameter of each of the island portions is made smaller than the island portion of FIG. 13 is exemplified. By increasing the number of the island portions, it is possible to increase the effect that can suppress the flexible film 52 from bending into the communication passage 544. Furthermore, by reducing the diameter of the island portion, the air resistance by the support portion 545 can be reduced.

Figure 19:
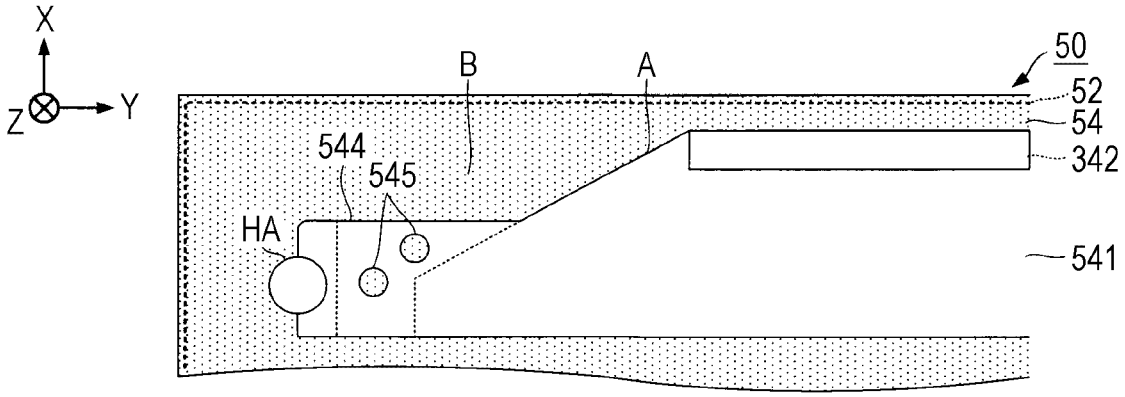
FIG. 19 is a plan view of the compliance plate according to a fourth modification example.

The shape of the communication passage 544 is not limited to the example of the first embodiment. The shape of the communication passage 544 may be changed according to the shape of the liquid storage chamber SR. For example, in the liquid storage chamber SR of a fourth modification example shown in FIG. 19, the length of the end portion (end portion in the Y direction) is longer than the liquid storage chamber SR in FIG. 6. It is possible to increase the number of the nozzles N arranged at the end portion by increasing the length of the end portion of the liquid storage chamber SR. FIG. 19 is a plan view of the compliance plate 50 according to the fourth modification example, and corresponds to FIG. 13.

Since the end portion of the liquid storage chamber SR in FIG. 19 projects to the atmospheric vent HA side from the end portion of the liquid storage chamber SR in FIG. 6, the width W of the communication passage 544 and the shape of the liquid storage chamber SR is partly different. In the communication passage 544 of FIG. 19, a width W1 in the Y direction of the portion overlapping the liquid storage chamber SR in the X direction is smaller than a width W2 in the Y direction of the portion not overlapping with the liquid storage chamber SR in the X direction. Therefore, the support portion 545 in FIG. 19 is constituted by the island portions arranged at the center of the width W1 and the center of the width W2 of the communication passage 544 one by one. With such a configuration, while the air resistance by the support portion 545 is reduced at each portion of the widths W1 and W2, the deterioration of the sealing property between the flow passage member 32 and the flexible film 52 around the liquid storage chamber SR can be suppressed. However, also in the configuration of FIG. 19, the number, arrangement, and shape (such as length, width, external shape, thickness, size) of the island portions are not limited to those shown in the drawings.

Figure 20:
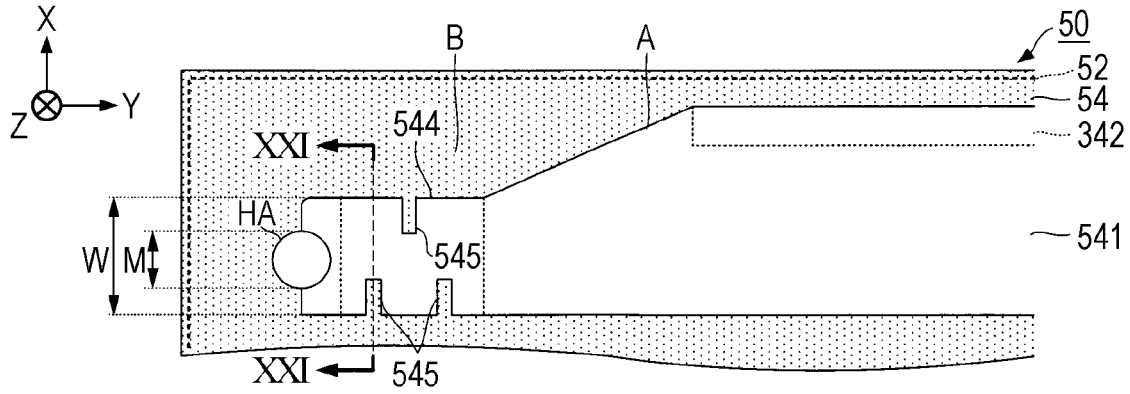
FIG. 20 is a plan view showing a configuration of the compliance plate according to a fifth modification example.
Figure 21:
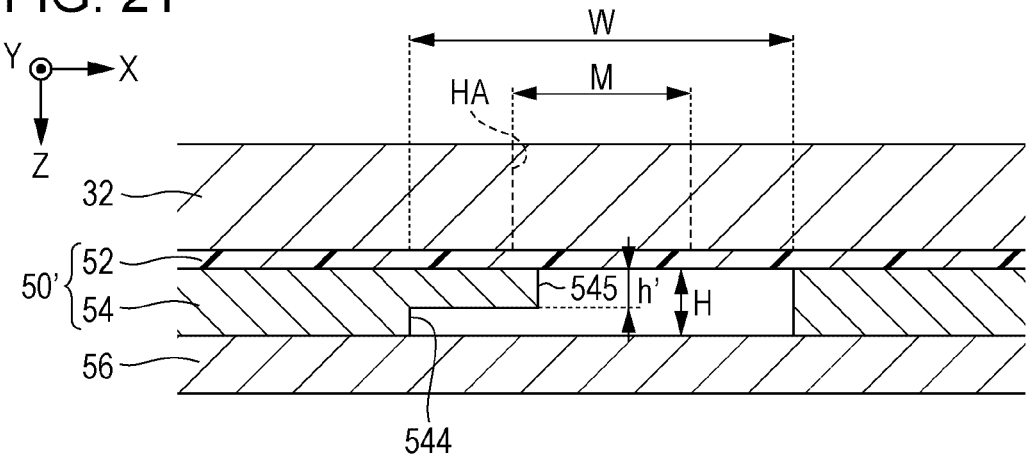
FIG. 21 is a sectional view taken along line XXI-XXI in FIG. 20.

In FIG. 13, the case where the support portion 545 is constituted by the island portions has been exemplified. However, the invention is not limited thereto, and the support portion 545 may be composed of a rail portion. FIGS. 20 and 21 are diagrams showing the configuration of the compliance plate 50 according to a fifth modification example, and the case where the support portion 545 is composed of a rail portion will be exemplified. FIG. 20 is a plan view showing the compliance plate 50 according to the fifth modification example, and FIG. 21 is a sectional view taken along line XXI-XXI in FIG. 20. As shown in FIGS. 20 and 21, the support portion 545 of the fifth modification example is constituted by a plurality of cantilever-shaped rail portions.

Each rail portion projects into the communication passage 544 from one side of two opposite side surfaces (negative side surface of the X direction and the positive side surface) of the communication passage 544. Each rail portion is connected to the side surface on one side of the communication passage 544 and is separated from the side surface opposed thereto. A thickness h' of each rail portion is thinner than the thickness H of the support plate 54, and a gap is formed between the rail portion and the fixation plate 56. Therefore, the area of the portion occupied by the support portion 545 in the cross section P of the communication passage 544 can be reduced, so that the air resistance by the support portion 545 can be reduced. In the fifth modification example, the case where three rail portions protrude one by one alternately from the two opposite side surfaces of the communication passage 544 is exemplified, but the invention is not limited thereto. The rail portions may protrude alternately by two or more, or, they may not be alternately provided. The rail portion may protrude from only one of the two opposing side surfaces of the communication passage 544. The number, the arrangement and the shape (such as length, width, outer shape, thickness, size) of the rail portion are not limited to those illustrated in drawings.

Second Embodiment

A second embodiment of the invention will be described. For the elements having the same operations and functions as those in the first embodiment in the following examples, the reference numerals used in the description of the first embodiment are used, and the detailed description thereof is appropriately omitted. In the first embodiment, a case where one liquid storage chamber SR is continuous in the Y direction is exemplified. However, in the second embodiment, a case where a plurality of liquid storage chambers SR are arranged side by side in the Y direction will be exemplified.

Figure 22:
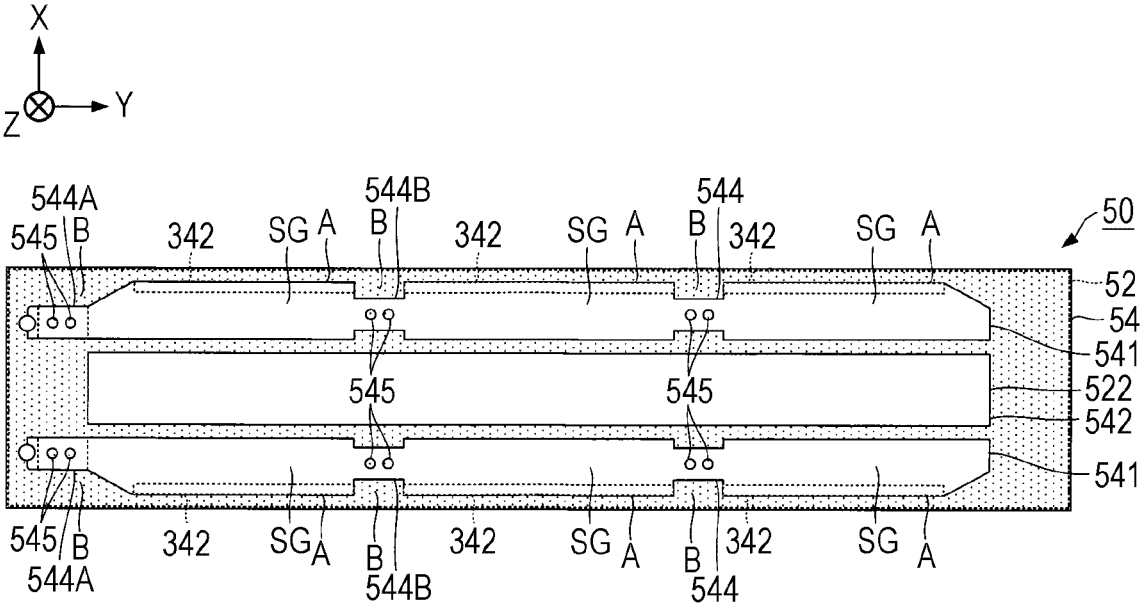
FIG. 22 is a plan view showing a compliance plate according to a second embodiment.

FIG. 22 is a plan view showing a compliance plate 50 according to the second embodiment. In FIG. 22, three liquid storage chambers SR are arranged side by side in the Y direction. In the support plate 54 of FIG. 22, the opening portion 541 in which the flexible film 52 is exposed is formed in the compliance region A overlapping each of the liquid storage chambers SR in a plan view from the Z direction. The most positive side opening portion 541 in the Y direction communicates with the atmospheric vent HA via a first communication passage 544A. Each opening portion 541 of the support plate 54 communicates via a second communication passage 544B disposed in a region B (region around each liquid storage chamber SR for sealing the flow passage member 32 and the flexible film 52) between the opening portions 541. Accordingly, each opening portion 541 communicates with the atmospheric vent HA via the first communication passage 544A and the second communication passage 544B, so that the movement of the flexible film 52 in the compliance region A corresponding to each liquid storage chamber SR is facilitated. As described above, the first communication passage 544A and the second communication passage 544B function as a communication passage that communicates the opening portion 541 with the atmosphere.

In the configuration of FIG. 22, by increasing the width W not only for the first communication passage 544A but also for the second communication passage 544B, when the flexible film 52 bends, the air in the opening portion 541 can easily enter and exit from the atmospheric vent HA via each of the communication passages 544A and 544B. Specifically, in a plan view from the Z direction, the width W (width in the X direction) of each of the communication passages 544A and 544B is larger than the diameter M of the atmospheric vent HA. Accordingly, as compared with the case where the width W of each communication passages 544A and 544B is smaller than the diameter M of the atmospheric vent HA, the air resistance in each communication passages 544A and 544B can be reduced. Therefore, the movement of the flexible film 52 is facilitated, and it is possible to increase the effect of absorbing the pressure fluctuation of the liquid storage chamber SR. In the plan view from the Z direction, by setting the width W of each of the communication passages 544A and 544B to be ½ or more of the maximum width Wmax (maximum width in plan view from the Z direction in the X direction) of the opening portion 541 in the cross section of each of the communication passages 544A and 544B that intersects with the Y direction, it is possible to remarkably reduce the air resistance in each of the communication passages 544A and 544B.

In the configuration of FIG. 22, not only the first communication passage 544A but also the second communication passage 544B, the flexible film 52 exposed in each of the communication passages 544A and 544B is supported by the support portion 545. The support portion 545 in FIG. 22 is exemplified by a case where it is constituted by the plurality of island portions. However, the support portion 545 of FIG. 22 may be composed of a rail portion as shown in FIG. 20. The number, the arrangement, and the shape (such as length, width, outer shape, thickness, size) of the island portions and the rail portion are not limited to those illustrated in drawings. As described above, even if the width W of each of the communication passages 544A and 544B is increased, it is possible to suppress the bending of the flexible film 52 exposed into each of the communication passages 544A and 544B by disposing the support portion 545 in each of the communication passages 544A and 544B, so that the deterioration of the sealing property between the flow passage member 32 and the flexible film 52 around each liquid storage chamber SR can be suppressed.

Moreover, in the configuration of FIG. 22, not only for the first communication passage 544A but also for the second communication passage 544B, the area of the portion occupied by the support portion 545 is smaller than the area of the other portions (area of the portion through which air passes) in the cross section including the support portion 545 among the cross sections of each of the communication passages 544A and 544B intersecting with the Y direction in which the each of communication passages 544A and 544B extends. The air resistance by the support portion 545 can be reduced, so that the air in each opening portion 541 in which the flexible film 52 bends can easily enter and exit from the atmospheric vent HA via each of the communication passages 544A and 544B. Accordingly, the movement of the flexible film 52 in the compliance region A exposed in the opening portion 541 is facilitated, so that the effect of absorbing the pressure fluctuation of the liquid storage chamber SR can be increased. According to the second embodiment as well, as in the first embodiment, the deterioration of the sealing property between the flow passage member 32 and the flexible film 52 around the liquid storage chamber SR can be suppressed while increasing the effect of absorbing the pressure fluctuation of the liquid storage chamber SR.

In FIG. 22, a configuration in which both the communication passages 544A and 544B are formed is exemplified, but only the communication passage 544B may be formed in the support plate 54. That is, the communication passage 544A may be omitted.

Modification Examples

The aspects and the embodiments exemplified above can be variously modified. Specific modes of modification are exemplified below. Two or more aspects randomly selected from the following examples and the above-described aspects can be appropriately merged within a range not inconsistent with each other.

(1) In the above-described embodiment, the serial head that reciprocally reciprocates the carriage 18 installed on the liquid ejecting head 20 along the X direction is exemplified. However, the invention is also applicable to a line head in which the liquid ejecting head 20 is disposed over the entire width of the medium 11.

(2) In the above-described embodiment, the piezoelectric type liquid ejecting head 20 using the piezoelectric element that applies the mechanical vibration to the pressure chamber is exemplified. However, it is also possible to adopt a thermal type liquid ejecting head using a heat generating element which generates bubbles inside the pressure chamber by heating.

(3) The liquid ejecting apparatus 10 exemplified in the above-described embodiment can be adopted for various apparatuses such as a facsimile apparatus and a copying machine in addition to the apparatus dedicated for printing. The application of the liquid ejecting apparatus 10 of the invention is not limited to printing. For example, a liquid ejecting apparatus that ejects a solution of a coloring material is used as a manufacturing apparatus that forms a color filter, an organic electro luminescence (EL) display, an FED (surface emitting display), and the like of a liquid crystal display apparatus. A liquid ejecting apparatus for ejecting a solution of a conductive material is used as a manufacturing apparatus for forming wirings and electrodes of a wiring substrate. It is also used as a chip manufacturing apparatus for ejecting a solution of a bioorganic matter as a kind of liquid.

This application claims priority to Japanese Patent Application No. 2017-250347 filed on Dec. 27, 2017 and Japanese Patent Application No. 2018-155602 filed on Aug. 22, 2018. The entire disclosures of Japanese Patent Application Nos. 2017-250347 and 2018-155602 are hereby incorporated herein by reference.

What is claimed is:

1. A flow passage structure comprising:

a flow passage member that constitutes a portion of a wall surface of a liquid storage chamber;

a flexible film that is laminated on the flow passage member and constitutes a portion of the wall surface of the liquid storage chamber;

a sealing body that is laminated on a side opposite to the flow passage member with the flexible film interposed therebetween and forms a space in which the flexible film is exposed;

communication passages that are formed in a region around the liquid storage chamber in the sealing body and causes the space to communicate with an atmosphere in a case where the sealing body is seen in a plan view from a direction in which the flow passage member and the flexible film are laminated; and a support portion that supports the flexible film in the communication passage.

2. The flow passage structure according to claim 1, wherein, in a cross section including the support portion among cross sections of the communication passages that intersect with a direction in which the communication passage extends, an area of a portion occupied by the support portion is smaller than an area of the other portions.

3. The flow passage structure according to claim 2, wherein the communication passage communicates with the atmosphere via an atmospheric vent distanced from the liquid storage chamber, and wherein a width of the communication passage in the cross section of the communication passage that intersects with the direction in which the communication passage extends is larger than a diameter of the atmospheric vent.

4. The flow passage structure according to claim 3, wherein the atmospheric vent is a through-hole formed in the flexible film.

5. The flow passage structure according to claim 4, wherein the atmospheric vent is formed in the flow passage member.

6. The flow passage structure according to claim 5, wherein the support portion is an island portion that is disposed in the communication passage.

7. The flow passage structure according to claim 6, wherein a plurality of the island portions are arranged side by side in a direction in which the communication passage extends.

8. The flow passage structure according to claim 7, wherein the support portion is a rail portion that projects into the communication passage from one or both sides of side surfaces of the communication passage facing each other.

9. The flow passage structure according to claim 8, wherein the width of the communication passage is ½ or more of a maximum width of a cross section of the space among cross sections of the communication passages that intersect with a direction in which the communication passage extends.

10. The flow passage structure according to claim 9, wherein the sealing body is constituted of a support plate that is laminated on the flexible film and a fixation plate that is laminated on the support plate on a side opposite to the flexible film, and wherein the support portion supports the flexible film that protrudes from the fixation plate toward the flexible film.

11. The flow passage structure according to claim 10, wherein, in a plan view of the sealing body, the communication passage is formed in a region corresponding to one end of the liquid storage chamber in the sealing body.

12. The flow passage structure according to claim 11, wherein a plurality of the liquid storage chambers are formed in the flow passage member, wherein a plurality of the spaces each corresponding to the plurality of liquid storage chambers are formed in the sealing body, and wherein the communication passage communicates with each of the spaces.

13. A liquid ejecting head comprising:

the flow passage structure according to claim 12; and a nozzle that ejects liquid supplied from the liquid storage chamber.

14. A liquid ejecting head comprising:

the flow passage structure according to claim 1; and a nozzle that ejects liquid supplied from the liquid storage chamber.

15. A liquid ejecting apparatus comprising:

the liquid ejecting head according to claim 14; and a control device that causes the liquid ejecting head to eject liquid.

16. The flow passage structure according to claim 1, wherein the communication passage communicates with the atmosphere via an atmospheric vent distanced from the liquid storage chamber, and wherein a width of the communication passage in the cross section of the communication passage that intersects with the direction in which the communication passage extends is larger than a diameter of the atmospheric vent.

17. The flow passage structure according to claim 16, wherein the width of the communication passage is ½ or more of a maximum width of a cross section of the space among cross sections of the communication passages that intersect with a direction in which the communication passage extends.

18. The flow passage structure according to claim 17, wherein the sealing body is constituted of a support plate that is laminated on the flexible film and a fixation plate that is laminated on the support plate on a side opposite to the flexible film, and wherein the support portion supports the flexible film that protrudes from the fixation plate toward the flexible film.

19. The flow passage structure according to claim 1, wherein the width of the communication passage is ½ or more of a maximum width of a cross section of the space among cross sections of the communication passages that intersect with a direction in which the communication passage extends.

20. The flow passage structure according to claim 1, wherein the sealing body is constituted of a support plate that is laminated on the flexible film and a fixation plate that is laminated on the support plate on a side opposite to the flexible film, and wherein the support portion supports the flexible film that protrudes from the fixation plate toward the flexible film.

* * * * *